US006132144A

United States Patent [19]

Zueck et al.

[11] Patent Number: 6,132,144

[45] Date of Patent: Oct. 17, 2000

[54] PASSIVE ANCHOR LATCH

[75] Inventors: Robert F. Zueck, Camarillo; James C. Miller, Oxnard; Robert J. Taylor, Camarillo; Karen Miller, Ventura, all of Calif.; David R. Shields, Austin, Tex.; Richard C. Lundberg, Larkspur, Calif.

[73] Assignee: The United States of America as represented by the Secretary of the Navy, Washington, D.C.

[21] Appl. No.: 09/213,473

[22] Filed: Dec. 17, 1998

[51] Int. Cl.[7] ..... E02D 5/74

[52] U.S. Cl. ..... 405/224; 114/230.2; 114/293; 405/223.1; 405/224.1; 441/3

[58] Field of Search ..... 405/224, 223.1, 405/195.1, 224.1; 114/230.2, 294, 299, 293, 230; 166/341–343; 403/371; 441/3

[56] References Cited

U.S. PATENT DOCUMENTS

| | | | |
|---|---|---|---|
| 2,476,309 | 7/1949 | Lang | 405/224 X |
| 3,086,368 | 4/1963 | Popper | 405/224 |
| 3,386,407 | 6/1968 | Mount | 405/224 X |
| 3,589,133 | 6/1971 | Lowd et al. . | |
| 3,597,931 | 8/1971 | Hard | 405/224 |
| 3,670,686 | 6/1972 | Heynolds | 441/3 X |
| 3,822,663 | 7/1974 | Boschen | 114/293 |
| 3,865,064 | 2/1975 | Van Heijst | 441/3 X |
| 3,967,460 | 7/1976 | Cassity . | |
| 3,982,401 | 9/1976 | Loggins | 405/224 X |
| 4,354,446 | 10/1982 | Goldsmith et al. | 114/293 X |
| 4,917,039 | 4/1990 | Siero | 441/3 |
| 4,943,188 | 7/1990 | Peppel | 405/224 |
| 5,855,178 | 1/1999 | Treu et al. | 114/230.2 |

*Primary Examiner*—Dennis L. Taylor
*Attorney, Agent, or Firm*—David Kalmbaugh

[57] ABSTRACT

A passive anchor latching mechanism which allows its user to attach a mooring line to an anchor without using a secondary mechanism such as a remotely operated vehicle to attach the cable or anchor wire to the anchor. The passive anchor latching mechanism comprises three elements: (1) a latch ring which may have a tether line removably coupled thereto; (2) an anchor post extending vertically upward from the top of the anchor; and (3) a crown line attached to the anchor and buoyed at the water's surface. The latch ring consist of a tail which attaches to the mooring line and a ring which slides downward along the crown line. The anchor post has an anchor collar coupled thereto which forms an annulus groove with the anchor post. The annulus grove latches the ring of the latch ring to the anchor post while the tail of the latch ring prevents the ring from detaching from the anchor post and riding backward up the anchor post once the latch ring is latched.

10 Claims, 3 Drawing Sheets

PASSIVE ANCHOR LATCH

BACKGROUND OF THE INVENTION

1. Field of the Invention

The present invention relates generally to underwater anchoring systems. More specifically, the present invention relates to a passive anchor latching mechanism that is used to attach a mooring line or anchor rod line to a sea floor anchor.

2. Description of the Prior Art

It is generally necessary to hold acoustic sensors, oceanographic measurement devices, hydrophones and other devices for measuring incident acoustic signals in precise underwater locations. In the past, these underwater measuring devices have been suspended underwater in a desired location by connecting the device to a buoy which applies an upward force on the device and an anchor which applies a downward force on the device. Mooring lines are generally used as the means to connect the underwater measuring device to the anchor and buoy.

Underwater measuring devices will often require more than one anchor, buoy and a related network of mooring lines to properly suspend the device. However, because of anchor displacements and settlement dynamics, it may be difficult or impossible to position the anchor or anchors accurately on the sea floor to achieve the required positioning tolerance for the suspended underwater measuring device or devices.

A solution to deployment of an underwater measuring device is to set anchors as accurately as possible in their desired locations, measure the location of the anchors after settlement, cut structural connecting lines to fit, and then connect the structural system together.

However, this does not fully resolve the deployment problem in that it may be very difficult or impossible to connect a structural line to an anchor that rests at the bottom of a water column. The problem is particularly difficult if the anchor is below depths that are conveniently accessible by a diver, if there is a requirement to make simultaneous connection to several anchors, or if the mooring line is too small for use in lowering the anchor.

In the past, solutions for remotely attaching a line to an underwater device are active and generally involve the use of a robotic arm on a remotely operated submersible vehicle. Past solutions for remotely detaching a line from an underwater object include a variety of active unlatching mechanisms. In this case, active means that a mechanical latch is attached and released by an acoustic signal, a tender line, a tripping weight, or any other secondary mechanism remotely operated from the surface of the water. However, these active latching mechanisms are often unreliable, expensive, and difficult to handle.

Accordingly, there is a need for a reliable, inexpensive, and easy to handle latching mechanism which will allow its user to attach a mooring line to an anchor without using a secondary mechanism such as a remotely operated vehicle as the means for attaching the mooring line to the anchor.

SUMMARY OF THE INVENTION

The present invention overcomes some of the disadvantages of the prior art including those mentioned above in that it comprises a relatively simple yet highly effective and efficient passive anchor latching mechanism which will allow its user to attach a mooring line to an anchor without using a secondary mechanism such as a remotely operated vehicle as the means for attaching the mooring line to the anchor.

The passive anchor latching mechanism comprises three elements: (1) a latch ring which may have a tether line removably coupled thereto; (2) an anchor post extending vertically upward from the top of the anchor; and (3) a crown line attached to the anchor and buoyed at the water's surface.

The latch ring consist of a tail adapted for attachment to a mooring line and a ring which slides downward along the crown line. The anchor post has an anchor collar coupled thereto which forms an annulus groove with the anchor post. The annulus grove latches the ring of the latch ring to the anchor post while the tail of the latch ring prevents the ring from detaching from the anchor post and riding back up the anchor post.

DETAILED DESCRIPTION OF THE PREFERRED EMBODIMENT

Figure 1:
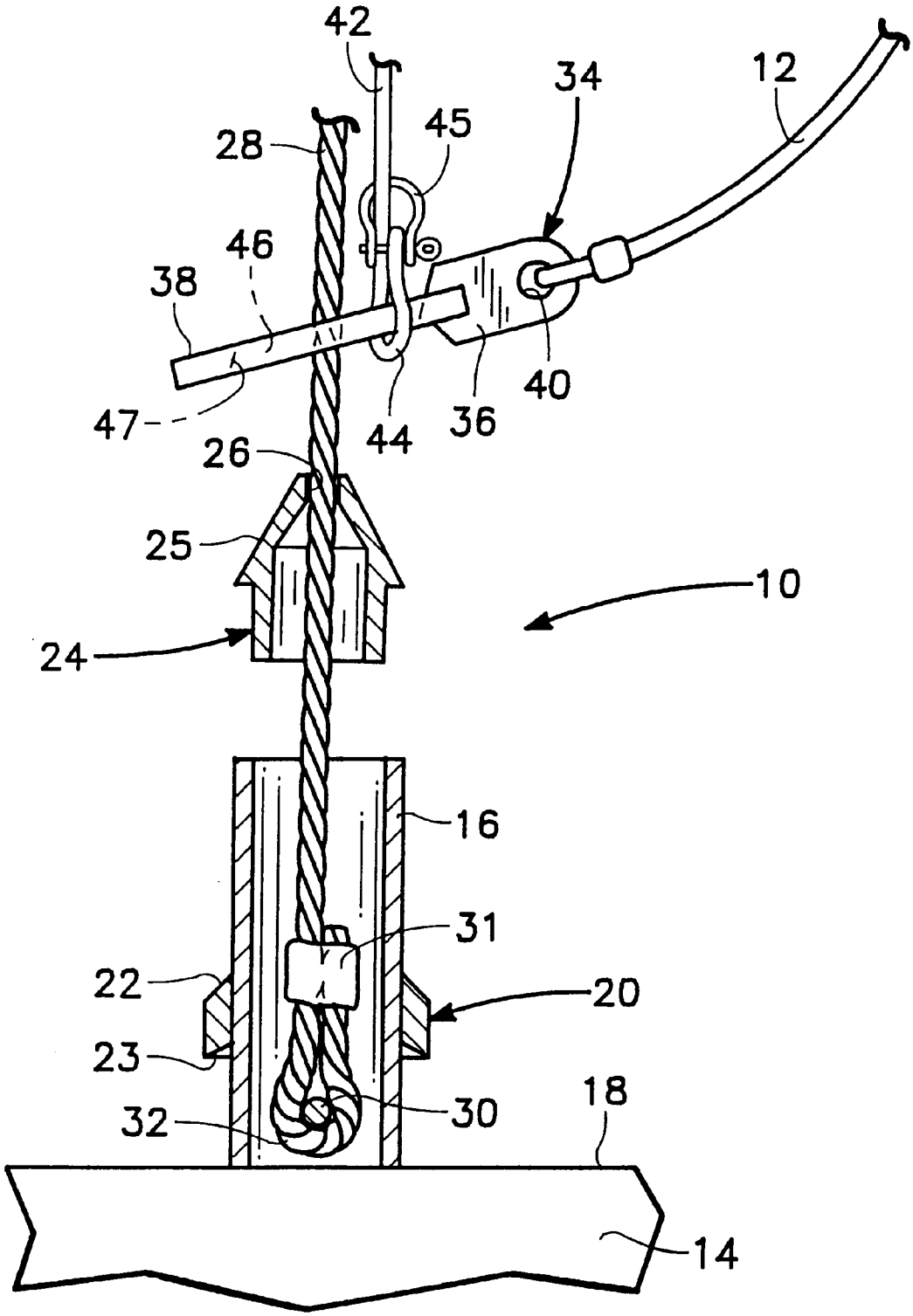
FIG. 1 is a schematic view of the passive anchor latching mechanism which comprises the present invention.

Referring to FIG. 1 there is shown a passive anchor latching mechanism, designated generally by the reference numeral 10 which will allow its user to attach a mooring line 12, or the like to an anchor 14 without using a secondary mechanism such as a remotely operated vehicle as the means for attaching the mooring line 12 to the anchor 14. Anchor 14 is generally positioned on the floor of the ocean at depths which are not conveniently accessible to a diver.

Passive anchor latching mechanism 10 includes a cylindrical shaped anchor post 16 which extends vertically upward from the top surface 18 of anchor 14. Anchor post 16 is secured to anchor 14 by means of a weld, bolts or the like. Anchor post 16 includes a latch collar 20 attached to the outer surface of anchor post 16 at least midway down anchor post 16. Latch collar 20 has a taper 22 at its upper end as shown in FIG. 1.

Figure 2:
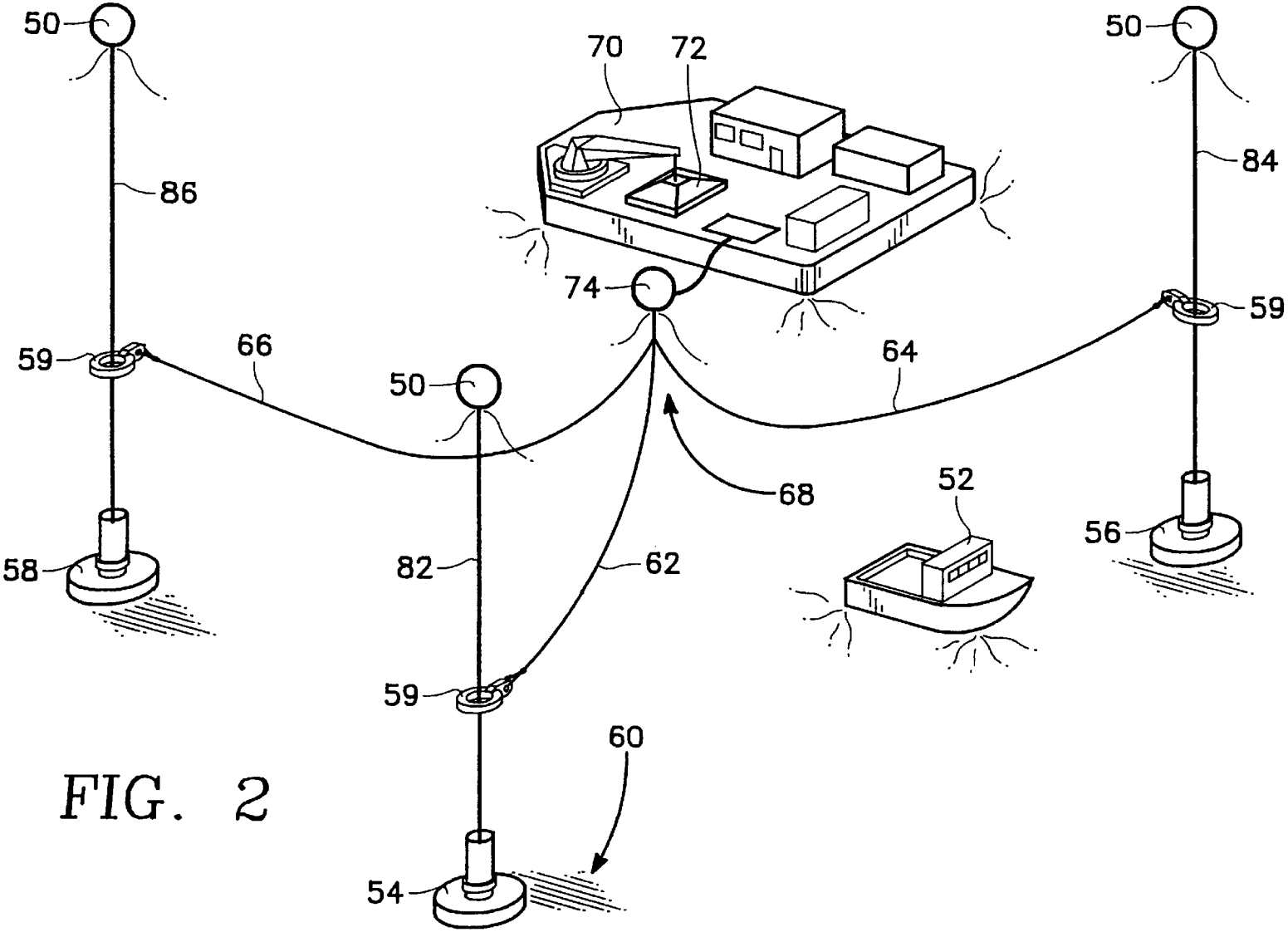
FIG. 2 is a illustrating the use of the latching mechanism of FIG. 1 in an underwater operational environment.

Referring to FIGS. 1 and 2, attached to the upper end of anchor post 16 is an anchor cone 24 which is shown in FIG. 1 as being separated from anchor post 16. Passing through an opening 26 in anchor cone 24 is a crown line 28 which has its upper end connected to a buoy 50 (FIG. 2) and its lower end connected to an anchor pin 30. Anchor pin 30 is attached to the inner surface of cylindrical shaped anchor post 16 extending therefrom which allows a soft eye 32 in crown line 30 to engage anchor pin 30 (FIG. 1) securing the lower end of crown line 28 to anchor 14. A swaging sleeve 31 positioned at the lower end of crown line 28 is used to form the soft eye 32 in crown line 28.

Slidably engaging crown line 30 is a latch ring 34 comprising a tail 36 and a ring 38 with tail 36 being attached to ring 38 by a weld (not illustrated). Ring 38 is the female component of passive anchor latching mechanism 10 while anchor post 16 is the male component of passive anchor latching mechanism 10. Tail 36 includes an opening 40 which is adapted to receive and secure mooring line 12 to latch ring 34.

One end of a tether line 42 is coupled to ring 38 of latch ring 34 while the opposite end of tether line 42 is connected to a winch (not illustrated) on board an ocean going vessel 52 such as the tug boat illustrated in FIG. 2. The end of tether line 42 coupled to latch ring 34 includes an eyelet 44 which is formed by use of a U shaped clamp and bolt assembly 45. Eyelet 44, in turn, allows the user of passive anchor latching mechanism 10 to easily attach tether line 42 to latch ring 34 by slipping eyelet 44 over tail 36 of latch ring 34. Eyelet 44 also allows for the easy removal of tether line 42 from latch ring 34 by again slipping eyelet 44 over tail 36 of latch ring 34.

It should be noted that tether line 42 is an optional element which is useful for initial lowering of latch ring 34.

Ring 38 of latch ring 34 has an opening 46 which allows latch ring 34 to slide downwardly along crown line 28 as the winch on board tug boat 52 releases tether line 42 from tug boat 52. It should be noted that the ring 38 of latch ring 34 and the tail 36 of latch ring 34 are each fabricated from steel plate which gives latch ring 34 sufficient weight to allow latch ring 34 to submerge to depth of anchor 14.

When latch ring 34 arrives at anchor cone 24, the cone portion 25 of anchor cone 24 engages opening 46 of latch ring 34 aligning opening 46 of latch ring 34 with anchor post 16. When latch ring 34 aligns itself with anchor cone 24, latch ring 34 will continue its downward slide along anchor pole 16 until latch ring 34 reaches the taper 22 of latch collar 20. The angle of the cone portion 25 of anchor cone 24 is approximately 60°, although this angle could be changed if so desired by the user of passive anchor latching mechanism 10.

Taper 22 of latch collar 20 is slanted at approximately the same angle as the cone portion 25 of anchor cone 24 which allows latch ring 34 to engage and align itself with anchor cone 24. After aligning itself with latch collar 20, latch ring 38 slides through latch collar 20 to the underside of latch collar 20.

Figure 3:
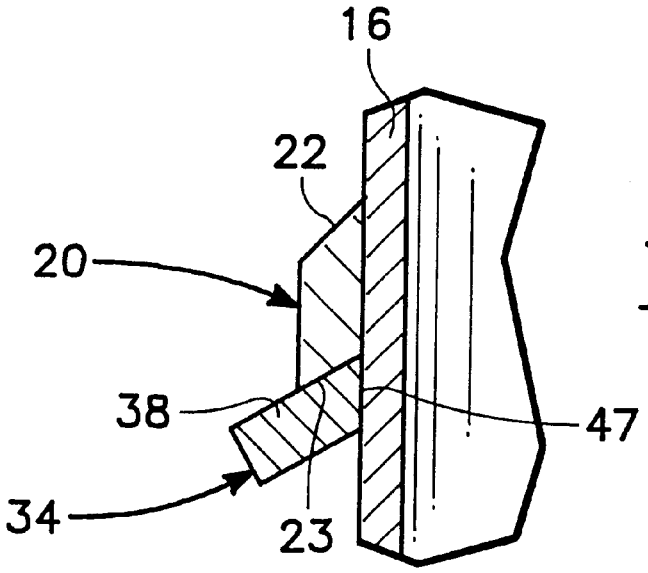
FIGS. 3 and 4 are partial views illustrating the latching mechanism of FIG. 1 secured to an anchor in the locked positioned.
Figure 4:
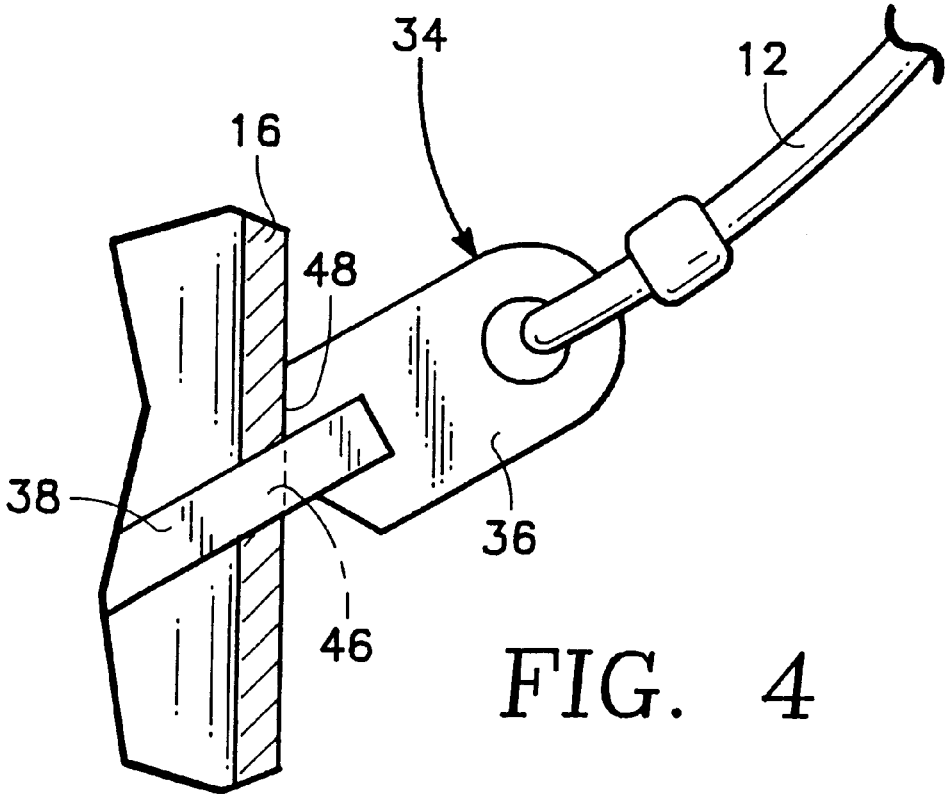

Referring to FIGS. 1, 3 and 4, the underside of latch collar 20 and the outer surface of anchor post 16 form an annulus groove 23 which receives and then engages the ring 38 of latch ring 34 in the manner illustrated in FIG. 3. It should be noted that inner surface 47 of ring 38 is slanted to fit securely in annulus groove 23 as is best illustrated by FIG. 3. When mooring line 12 pulls ring 38 upward, ring 38 engages annulus groove 23 in the manner shown in FIG. 3 and mating surface 48 of tail 36 is brought into alignment with the outer surface of anchor post 16 as shown in FIG. 4. The geometry of the engagement surfaces as shown in FIGS. 3 and 4 prevent ring 38 from riding back up anchor post 16 by any normal action of mooring line 12 once latch ring 34 engages anchor post 16 and latch collar 20 in the manner illustrated in FIGS. 3 and 4.

Referring to FIG. 2, there is shown an example of a marine operation which uses the passive anchor latching mechanism 10 of FIG. 1. Three gravity anchors 54, 56 and 58 are positioned on the ocean floor 60 such that their associated mooring lines 62, 64 and 66 form a tripod mooring system 68 which holds a node buoy 74 in a fixed position at the apex of tripod mooring system 68.

To secure each of the mooring lines 62, 64 and 66 to their respective anchors 54, 56 and 58, each mooring line 62, 64 and 66 has a latch ring 59 (identical to latch ring 34, FIG. 1) which is in slidable engagement with its associated crown line 82, 84 or 86. The crown lines 82, 84 and 86 are each connected to one of three buoys 50 which float on the ocean's surface The three latch rings 59 each slide down their associated crown line 82, 84 or 86 until they engage and then latch onto their respective anchor 54, 56 or 58.

Although not shown in FIG. 2, a tether line may be useful for initially lowering each latch ring 59 from vessel 52 to a depth where mooring lines 62, 64 and 66 become taut. The three latch rings 59 are then lowered to their respective anchors 54, 56 and 58 by depressing node buoy 74 using an over-bearing weight 72 lowered from vessel 70. The over-bearing weight 72 is then raised when the three latch rings 59 latch onto the anchor post 16 of their respective anchors 54, 56 and 58.

The crown lines 82, 84 and 86 may then be removed by lowering a wire cutter downward along each crown line 82, 84 or 86 and then cutting the crown line 82, 84 or 86 near anchor cone 24 (FIG. 1).

From the foregoing, it may readily be seen that the present invention comprises a new, unique and exceedingly useful passive anchor latching mechanism which will allow its user to attach a cable, anchor wire or the like to an anchor which constitutes a considerable improvement over the known prior art. Obviously, many modifications and variations of the present invention are possible in light of the above teachings. It is, therefore to be understood that within the scope of the appended claims that the invention may be practiced otherwise than as specifically described.

What is claimed is:

1. A passive anchor latch mechanism for securing a mooring line to an anchor embedded on the sea floor, comprising:

a cylindrical shaped anchor post extending vertically upward from a top surface of said anchor, said cylindrical shaped anchor post having an anchor cone attached to an upper end thereof;

a crown line having a lower end thereof connected to said cylindrical shaped anchor post and an upper end thereof connected to a buoy floating on the water surface;

a latch collar attached to an outer surface of said cylindrical shaped anchor post, said latch collar being positioned approximately at a midpoint of said cylindrical shaped anchor post;

a latch ring in slidable engagement with said crown line and said cylindrical shaped anchor post, said latch ring being connected to said mooring line;

an annulus groove positioned on an underside of said latch collar at the outer surface of cylindrical shaped anchor post;

said latch ring sliding in a downward direction from said buoy along said crown line over said cylindrical shaped anchor post and said latch collar to the underside of said latch collar;

said annulus groove receiving and then engaging said latch ring to secure said latch ring and said mooring line to said anchor.

2. The passive anchor latch mechanism of claim 1 further comprising a tether line having one end thereof coupled to said latch ring and the opposite end thereof coupled to a winch on board an ocean going vessel.

3. The passive anchor latch mechanism of claim 1 further comprising an anchor pin attached to an inner surface of said cylindrical shaped anchor post, said anchor pin extending from the inner surface of said cylindrical shaped anchor post allowing a soft eye at said lower end of said crown line to engage said anchor pin securing the lower end of said crown line to said anchor.

4. The passive anchor latch mechanism of claim 1 wherein said latch ring comprises:

a ring in slidable engagement with said crown line and said cylindrical shaped anchor post; and a tail attached to said ring, said tail having an opening adapted to receive and secure said mooring line to said latch ring.

5. The passive anchor latch mechanism of claim 4 wherein said tail has a mating surface which aligns with the outer surface of said cylindrical shaped anchor post.

6. The passive anchor latch mechanism of claim 5 wherein said ring has a slanted inner surface which fits securely in said annulus groove, the slanted inner surface of said ring and the mating surface of said tail comprising engagement surfaces for preventing said latch ring from moving in an upward direction along said cylindrical shaped anchor post to said crown line.

7. A passive anchor latch mechanism for securing a mooring line to an anchor embedded on the sea floor, comprising:

a cylindrical shaped anchor post extending vertically upward from a top surface of said anchor, said cylindrical shaped anchor post having an anchor cone attached to an upper end thereof;

a crown line having a lower end thereof connected to said cylindrical shaped anchor post and an upper end thereof connected to a buoy floating on the water surface;

a latch collar attached to an outer surface of said cylindrical shaped anchor post, said latch collar being positioned approximately at a midpoint of said cylindrical shaped anchor post;

a latch ring in slidable engagement with said crown line and said cylindrical shaped anchor post, said latch ring being connected to said mooring line;

said latch ring including a ring in slidable engagement with said crown line and said cylindrical shaped anchor post and a tail attached to said ring, said tail having an opening for receiving and securing said mooring line to said latch ring;

an annulus groove positioned on an underside of said latch collar at the outer surface of cylindrical shaped anchor post;

said ring of said latch ring sliding in a downward direction from said buoy along said crown line over said cylindrical shaped anchor post and said latch collar to the underside of said latch collar;

said annulus groove receiving and then engaging said said ring of said latch ring to secure said latch ring and said mooring line to said anchor a tether line having one end thereof coupled to said ring of said latch ring and the opposite end thereof coupled to an ocean going vessel.

8. The passive anchor latch mechanism of claim 7 further comprising an anchor pin attached to an inner surface of said cylindrical shaped anchor post, said anchor pin extending from the inner surface of said cylindrical shaped anchor post allowing a soft eye at said lower end of said crown line to engage said anchor pin securing the lower end of said crown line to said anchor.

9. The passive anchor latch mechanism of claim 7 wherein said tail has a mating surface which aligns with the outer surface of said cylindrical shaped anchor post.

10. The passive anchor latch mechanism of claim 9 wherein said ring has a slanted inner surface which fits securely in said annulus groove, the slanted inner surface of said ring and the mating surface of said tail comprising engagement surfaces for preventing said latch ring from moving in an upward direction along said cylindrical shaped anchor post to said crown line.

* * * * *